US008863969B2

(12) United States Patent
Lau

(10) Patent No.: US 8,863,969 B2
(45) Date of Patent: Oct. 21, 2014

(54) FEEDING BOTTLE SYSTEM

(71) Applicant: Chantal Lau, Santa Fe, NM (US)

(72) Inventor: Chantal Lau, Santa Fe, NM (US)

( * ) Notice: Subject to any disclaimer, the term of this patent is extended or adjusted under 35 U.S.C. 154(b) by 0 days.

(21) Appl. No.: 13/674,751

(22) Filed: Nov. 12, 2012

(65) Prior Publication Data

US 2013/0153527 A1 Jun. 20, 2013

Related U.S. Application Data

(63) Continuation-in-part of application No. 12/675,134, filed as application No. PCT/FR2008/001217 on Aug. 29, 2008, now Pat. No. 8,308,001.

(30) Foreign Application Priority Data

Sep. 4, 2007 (FR) ..... 07 06190

(51) Int. Cl.

| | |
|---|---|
| ***A61J 9/00*** | (2006.01) |
| ***B65D 23/00*** | (2006.01) |
| ***B65D 85/72*** | (2006.01) |
| ***B65D 41/02*** | (2006.01) |
| ***B65D 43/02*** | (2006.01) |
| ***A61J 9/04*** | (2006.01) |

(52) U.S. Cl.

CPC ..... *A61J 9/04* (2013.01); *A61J 2200/76* (2013.01)

USPC ..... 215/365; 215/11.1; 215/11.5; 215/230; 206/459.1; 206/459.5

(58) Field of Classification Search

USPC ..... 215/11.1–11.6, 365, 230; 206/459.1, 206/459.5

See application file for complete search history.

(56) References Cited

U.S. PATENT DOCUMENTS

| | | | |
|---|---|---|---|
| 484,811 | A | 10/1892 | Newell |
| 1,056,113 | A | 1/1913 | Morgan |
| 1,669,892 | A | 5/1928 | Beck |
| 1,972,895 | A | 9/1934 | MacCoy |
| 2,372,281 | A | 1/1945 | Jordan |
| 2,744,646 | A | 1/1956 | Blackstone |

(Continued)

FOREIGN PATENT DOCUMENTS

| | | | |
|---|---|---|---|
| DE | 10102997 | A1 | 7/2002 |
| EP | 0555165 | A1 | 8/1993 |
| GB | 2139903 | A1 | 11/1984 |

OTHER PUBLICATIONS

Lau C, Schanler RJ. Oral feeding in premature infants: advantage of a self-paced milk flow. Acta Paediatr. 2000;89:453-9.

(Continued)

*Primary Examiner* — Fenn Mathew
*Assistant Examiner* — Jennifer Castriotta
(74) *Attorney, Agent, or Firm* — Robert D. Watson

(57) ABSTRACT

Feeding bottle (10) comprising a neck to which a teat (14) is attached, characterized in that it comprises at least two visual marks (20, 22) located on one and the same circumference near the neck or near the teat and separated from one another about the axis of the feeding bottle, one of these marks (20) defining an angular position of the feeding bottle (10) about its axis for which the other mark (22) indicates a point through which the free surface (24) of the liquid contained in the feeding bottle needs to pass in order for the hydrostatic pressure of the liquid at an outlet orifice (16) of the teat (14) to be substantially zero.

9 Claims, 14 Drawing Sheets

(56) References Cited

U.S. PATENT DOCUMENTS

| | | | | |
|---|---|---|---|---|
| 3,028,983 | A | | 1/1962 | Barr |
| 3,092,276 | A | | 6/1963 | Schaar |
| 3,139,064 | A | | 6/1964 | Harle |
| 3,532,242 | A | | 10/1970 | Tibbs |
| 3,768,682 | A | | 10/1973 | Meyers et al. |
| 3,924,620 | A | | 12/1975 | Seunevel |
| 4,548,157 | A | | 10/1985 | Hevoyan |
| 4,685,577 | A | | 8/1987 | Chen |
| 4,700,856 | A | * | 10/1987 | Campbell et al. ..... 215/11.3 |
| 4,728,006 | A | | 3/1988 | Drobish et al. |
| 5,117,994 | A | | 6/1992 | Leblanc et al. |
| 5,263,599 | A | | 11/1993 | Sklar |
| 5,499,729 | A | | 3/1996 | Greenwood et al. |
| 5,531,338 | A | | 7/1996 | Sklar |
| 5,544,766 | A | | 8/1996 | Dunn et al. |
| 5,553,726 | A | | 9/1996 | Park |
| 5,570,796 | A | | 11/1996 | Brown et al. |
| 5,716,347 | A | | 2/1998 | Gibbs et al. |
| 5,779,071 | A | | 7/1998 | Brown et al. |
| 5,944,205 | A | | 8/1999 | LaJoie et al. |
| 6,003,698 | A | | 12/1999 | Morano |
| 6,053,342 | A | | 4/2000 | Chomik |
| 6,138,710 | A | | 10/2000 | Chomik et al. |
| RE37,016 | E | | 1/2001 | Morano |
| 6,321,931 | B1 | | 11/2001 | Hakim et al. |
| 6,786,344 | B2 | | 9/2004 | Kipperman et al. |
| RE38,692 | E | | 2/2005 | Wong |
| 6,991,122 | B2 | | 1/2006 | Holley, Jr. |
| 6,994,225 | B2 | | 2/2006 | Hakim |
| 7,134,564 | B2 | | 11/2006 | Verbovszky |
| 7,185,784 | B2 | | 3/2007 | Connors, Jr. et al. |
| 7,503,461 | B1 | | 3/2009 | Hoffman et al. |
| 7,537,128 | B2 | | 5/2009 | Nachumi |
| 7,556,172 | B2 | | 7/2009 | Lane |
| 7,828,165 | B2 | | 11/2010 | Brown et al. |
| 7,837,056 | B2 | | 11/2010 | Stribling et al. |
| 2004/0144744 | A1 | | 7/2004 | Holley, Jr. |
| 2004/0256345 | A1 | | 12/2004 | Lundquist |
| 2005/0023239 | A1 | | 2/2005 | Lin |
| 2005/0184022 | A1 | | 8/2005 | Dunn et al. |
| 2005/0205589 | A1 | | 9/2005 | Davis et al. |
| 2006/0260651 | A1 | | 11/2006 | Holley, Jr. |
| 2006/0261064 | A1 | | 11/2006 | Holley, Jr. |
| 2006/0278597 | A1 | | 12/2006 | Daugherty et al. |
| 2007/0051727 | A1 | | 3/2007 | Holley, Jr. |
| 2008/0099422 | A1 | | 5/2008 | Rees |
| 2008/0128647 | A1 | | 6/2008 | Clawson |
| 2008/0173612 | A1 | | 7/2008 | Renz |
| 2008/0237176 | A1 | | 10/2008 | Pillado |
| 2010/0032039 | A1 | | 2/2010 | Nemoto et al. |
| 2010/0147862 | A1 | | 6/2010 | Keefe et al. |
| 2010/0308003 | A1 | | 12/2010 | Morrill et al. |
| 2010/0314347 | A1 | | 12/2010 | Haberman et al. |
| 2011/0000867 | A1 | | 1/2011 | Lau et al. |
| 2011/0011819 | A1 | | 1/2011 | Lee |
| 2011/0056968 | A1 | | 3/2011 | McNamara et al. |
| 2011/0068078 | A1 | | 3/2011 | Brown et al. |
| 2011/0079570 | A1 | | 4/2011 | Brown et al. |

OTHER PUBLICATIONS

Fucile S, Gisel E, Schanler RJ, Lau C. A Controlled-flow Vacuum-free Bottle System Enhances Preterm Infants' Nutritive Sucking Skills. Dysphagia 2009; 24:145-151.

Lau C, Hurst N. Oral feeding in infants. Curr Probl Pediatr. 1999;29:105-24.

Lau C, Alagugurusamy R, Schanler RJ, Smith EO, Shulman RJ. Characterization of the developmental stages of sucking in preterm infants during bottle feeding. Acta Paediatr. 2000;89:846-52.

Lau C, Smith EO, Schanler RJ. Coordination of suck-swallow and swallow respiration in preterm infants. Acta Paediatr. 2003;92:721-7.

Lau C, Sheena HR, Shulman RJ, Schanler RJ. Oral feeding in low birth weight infants. J Pediatr. 1997;130:561-9.

Lau C, Kusnierczyk I. Quantitative evaluation of infants nonnutritive and nutritive sucking. Dysphagia. 2001;16:58-67.

Scheel CE, Schanler RJ, Lau C. Does the choice of bottle nipple affect oral feeding performance of very-low-birth-weight (VLBW) infants? Acta Paediatr. 2005;94:1-8.

Alagugurusamy R, Schanler RJ, Lau C. Identification of stages of sucking behavior in premature infants that may be used as indicators of feeding performance. Pediatr Res 1998; 43: 255A.

Lau C, Schanler RJ. Oral motor function in the neonate. Clin Perinatol 1996; 23: 161-78.

Fucile S, Gisel E, Lau C. Oral stimulation accelerates the transition from tube to oral feeding in preterm infants. J Pediatr 2002; 141: 230-6.

Fucile S, Gisel EG, Lau C. Effect of an oral stimulation program on sucking skill maturation of preterm infants. Dev Med Child Neurol 2005; 47: 158-62.

Amaizu N, Shulman RJ, Schanler RJ, Lau C. Maturation of oral feeding skills in preterm infants. Acta Paediatrica 2008 97, pp. 61-67.

Goldfield EC, Richardson MJ, Kimberly GL, Margetts S. Coordination of Sucking, Swallowing and Breathing and Oxygen Saturation During Early Infant Breast-feeding and Bottle-feeding, Pediatric Research, vol. 60, No. 4, 2006.

Lau, C. Feeding Preterm Infants: What do we know?, AgroFOOD industry hi-tech, Jul./Aug. 2009, vol. 20, No. 4.

Fucile S, Gisel E, McFarland D, Lau C., "Oral and non-oral sensorimotor interventions enhance oral feeding performance in preterm infants", Developmental Medicine & Child Neurology, published online Jun. 27, 2011.

Goldfield E, Wolff P, Schmidt, "Dynamics of oral-respiratory coordination in full-term and preterm infants", Developmental Science 2:3 (1999), pp. 363-373.

Jain L, Sivieri E., Abbasi S, Bhutani V. K., "Energetics and mechanics of nutritive sucking in the preterm and term neonate", The Journal of Pediatrics, vol. 111, No. 6, part I, Dec. 1987, pp. 894-898.

Kron R, Ipsen J, Goddard K, "Consistent Individual Differences in the Nutritive Sucking Behavior of the Human Newborn", Psychosomatic Medicine, vol. XXX, No. 2, 1968, pp. 151-161.

Lau C, Henning S, "A noninvasive method for determining patterns of milk intake in the breast-fed infant", Journal of Pediatric Gastroenterology and Nutrition, vol. 9, No. 4, pp. 481-487, 1989.

Pickier R, Reyna B, "Effects of Non-Nutritive Sucking on Nutritive Sucking, Breathing, and Behavior During Bottle Feedings of Preterm Infants", Advances in Neonatal Care, vol. 4, No. 4 Aug. 2004: pp. 226-234.

Sameroff AJ, The components of sucking in the human newborn. J Exp Child Psychol 1968; 6:607-623.

Waterland R, Berkowitz R, Stunkard A, Stallings V, "Calibrated-orifice nipples for measurement of infant nutritive sucking", The Journal of Pediatrics, vol. 132, No. 3, Part I, pp. 523-526, Mar. 1998.

* cited by examiner

FEEDING BOTTLE SYSTEM

CROSS-REFERENCE TO RELATED APPLICATIONS

This application is a Continuation-in-Part of U.S. application Ser. No. 12/675,134 by Lau et al., filed Sep. 21, 2010, and published on Jan. 6, 2011 as US Patent Application Publication No. US 2011/0000867 A1; and which issued as U.S. Pat. No. 8,308,001 B2 on Nov. 13, 2012; which claims the benefit of PCT application No. PCT/FR2008/001217, filed Aug. 29, 2008; and which also claims the benefit of foreign patent application No. 0706190 filed Sep. 4, 2007 in France; all of which are incorporated herein by reference.

STATEMENT REGARDING FEDERALLY SPONSORED RESEARCH OR DEVELOPMENT

This invention was made, in part, with US government support under Contract No. HD028140 awarded by the National Institutes of Health. The US government has certain rights in the invention.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to the feeding of infants by means of feeding bottles, and more particularly the improvement of the safety and comfort of infants during feeding with a feeding bottle.

2. Description of Related Art

Feeding with a feeding bottle has for the infant risks of suffocating, choking or liquid going down the wrong way, when the rate or the pressure of the liquid flowing through the teat is too high.

The capacity of an infant to feed effectively and without risk depends on its ability to coordinate the steps of suction, deglutition and respiration, as well as its suction force. Although the majority of full-term babies are able to control and adjust the force and the duration of the suction in order to maintain an acceptable rate of liquid in light of their capacity to coordinate the three aforementioned steps, this is not the case for a few of them, in particular in the event of fatigue, and for the majority of premature babies or who have chronic diseases.

A person giving the feeding bottle has no way of knowing the rate that a baby is able to support and the suction force that then baby is able to develop, although this person is the only person in a position to control the rate of the liquid, not the infant itself. This rate depends in fact substantially on the hydrostatic pressure of the liquid at the outlet orifice of the teat of the feeding bottle, and therefore on the inclination of the feeding bottle in relation to the horizontal and to its level of filling. However it appears that less than one person in ten is able to correctly incline a feeding bottle during a feeding in order to maintain an acceptable rate of liquid for the infant. Faced with the uncontrolled flow of liquid flowing from the feeding bottle, the infant can have difficulties in getting its breath back or for resting, and as such runs the risk of suffocation, coughing, spittle, aspiration of liquid into the lungs or fatigue. Over time, the infant can develop an aversion for orality, or catch pneumonia due to the frequent penetration of liquid in the lungs.

It is therefore desirable to put the child in a position able to control himself the rate of the liquid flowing through the teat.

The invention has in particular for purpose to provide a solution that is simple, economical and effective for this problem, making it possible to prevent the aforementioned disadvantages.

BRIEF SUMMARY OF THE INVENTION

It has for object a feeding bottle of which the hydrostatic pressure can be maintained at the outlet orifice of the teat at a substantially zero value, in such a way that the rate of liquid flowing through the teat can be controlled without difficulty by the infant who is feeding and that the liquid flows only if the baby is feeding.

It proposes for this purpose a feeding bottle, comprising a neck whereon is mounted a teat, characterized in that it comprises at least two visual marks located on the same circumference in the vicinity of the neck or of the teat and separated from one another around the axis of the feeding bottle, one of these marks defining an angular position of the feeding bottle around its axis for which the other mark indicates a point through which the free surface of the liquid contained in the feeding bottle needs to pass in order for the hydrostatic pressure of the liquid on an outlet orifice of the teat to be substantially zero.

The marks carried by the feeding bottle allow as such to indicate to the person who is holding the feeding bottle, the inclination to give to the feeding bottle so that the free surface of the liquid in the feeding bottle passes substantially through the outlet orifice of the teat in such a way that the hydrostatic pressure therein is substantially zero, and this regardless of the quantity of liquid contained in the feeding bottle. A first of the marks is intended to be placed upwards and as such indicates how to direct the feeding bottle around its axis, while a second mark indicates to the person holding the feeding bottle how to incline it in relation to the horizontal, so that the free surface of the liquid contained in the feeding bottle passes through this mark. The aforementioned marks as such allow the person giving the feeding bottle to know, at every instant and regardless of the filling rate of the feeding bottle, what inclination to give to the feeding bottle so that the infant can feed in the best conditions.

According to a first embodiment of the invention, the visual marks are formed or printed on a tightening ring of the teat on the neck. The marks are then formed as close as possible to the teat and make it possible to properly control the hydrostatic pressure in the feeding bottle during the feeding.

According to a second embodiment of the invention, the visual marks are formed or printed on the neck of the feeding bottle. This makes it possible in particular to benefit from the advantages procured by the invention by mounting any teat and any tightening ring on the feeding bottle, since the latter comprises the visual marks proposed by the invention.

According to a third embodiment of the invention, the visual marks are formed or printed on a rotatably mounted crown on the tightening ring of the teat. This alternative is particularly well suited for the use of an asymmetric teat, since it allows the user of the feeding bottle to correctly position the crown comprising the visual marks in relation to the teat, after fastening the teat on the feeding bottle.

According to a fourth embodiment of the invention, the visual marks are formed or printed on the teat of the feeding bottle. This alternative is well suited for teats of a large size of which at least one portion of the base remains visible during the feeding. This arrangement, wherein the marks are placed as close as possible to the outlet orifice of the teat, makes it possible to provide very precise indications as to the inclination to give to the feeding bottle, and as such offers a particularly effective means for reducing the hydrostatic pressure of the liquid at the outlet orifice of the teat.

Advantageously, the feeding bottle comprises a unidirectional air intake valve, and this valve forms one of the aforementioned marks. Such a valve makes it possible to prevent the establishment of a vacuum inside the feeding bottle as feeding takes place, and the problems of fatigue that stem from this for the infant. According to the invention, this valve also plays the role of a visual mark, for example in order to define the angular position of the feeding bottle around its axis. A visual mark can also be formed under the valve in order to indicate a maximum level of filling for the feeding bottle.

In a preferred embodiment, the feeding bottle comprises two visual symmetrical positioning marks of the free surface of the liquid, located on either side of an angular positioning mark of the feeding bottle. The presence of these two symmetrical marks makes the positioning of the feeding bottle as easy when the user is holding the feeding bottle with his right hand as when he is holding it with the left hand.

Typically, the angular separation between the positioning marks of the free surface of the liquid and the angular positioning of the feeding bottle is equal to approximately 45 degrees.

The invention also relates to a set of several feeding bottles of the type described hereinabove, wherein the colors of the visual marks differ from one feeding bottle to the next.

This makes it possible to distinguish the feeding bottles from one another and to find a particular feeding bottle in a set of feeding bottles.

BRIEF DESCRIPTION OF THE SEVERAL VIEWS OF THE DRAWING(S)

The invention shall be better understood and other details, advantages and characteristics of the latter shall appear more clearly when reading the following description provided by way of a non-restrictive example, in reference to the annexed drawings wherein.

DETAILED DESCRIPTION OF THE INVENTION

Figure 1:
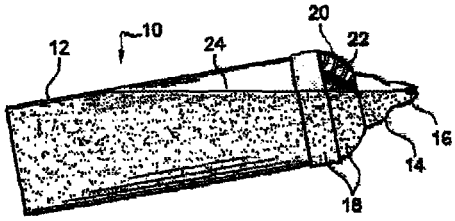
FIGS. 1 to 3 are side diagrammatical views of a feeding bottle according to a first embodiment of the invention.

FIG. 1 shows a feeding bottle 10 of the conventional type, comprising a transparent or translucent recipient (body) 12 made of glass, plastic or analogous material, and a teat 14 comprising an outlet orifice 16, mounted on a neck of the recipient (body) 12 by means of a tightening ring 18 which is screwed on the recipient (body) 12.

The tightening ring 18 of the teat 14 comprises a central visual mark 20 formed for example of a colored dash, intended to be directed upwards during the feeding, and at least one side visual mark 22 formed for example of a colored dash, through which the user of the feeding bottle must pass the free surface 24 of the liquid contained in the feeding bottle in order to maintain a substantially zero hydrostatic pressure at the orifice 16 of the teat. These two marks 20 and 22 can be of a color or of any nature making it possible to distinguish them well from the rest of the ring 18.

The angular separation around the axis of the feeding bottle between the visual mark 20 and the mark 22 is approximately 45 degrees.

In a convenient way, the tightening ring 18 comprises another visual side mark 22 symmetric of the first side mark 22 (not visible in FIGS. 1 to 3), in order to allow for the use of the feeding bottle by holding it as well with one hand as with the other.

Figure 2:
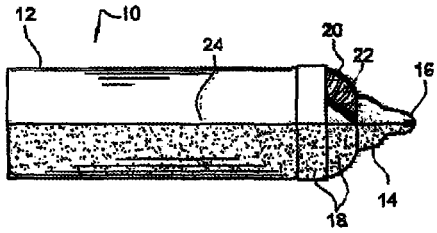
Figure 3:
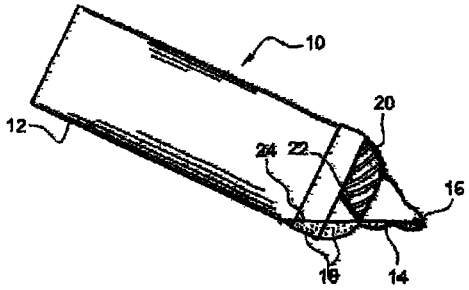

FIGS. 1 to 3 show the feeding bottle 10 in various positions of use corresponding to the different levels of filling of this feeding bottle.

In FIG. 1, the feeding bottle 10 is substantially filled to the maximum of its capacity. It must be slightly inclined in such a way as to direct the teat 14 upwards so that the free surface 24 of liquid passes through the visual side mark 22. It appears clearly in FIG. 1 that the free surface 24 thus passes in the vicinity of the orifice 16 of the teat 14, which ensures that the hydrostatic pressure at this level is substantially zero.

In FIG. 2, the feeding bottle 10 has been emptied a little of its contents and must now be held substantially horizontally in order to maintain the free surface 24 of the liquid on visual side mark 22 while still filling the teat. This free surface still passes in the vicinity of the orifice 16 of the teat 14 and the hydrostatic pressure as such remains very low.

Finally, in FIG. 3, there is only a small amount of liquid left in the feeding bottle 10, which must now be inclined in such a way as to direct the teat 14 downwards so that the free surface 24 of the liquid passes through the visual side mark 22.

The dashes which form the marks 22 have a length of a magnitude of 5 mm for example, in such a way that it is easy to maintain the free surface of the liquid in the feeding bottle at the level of one of these dashes.

Alternatively, the marks can be points or circles of a few millimeters in diameter, or any other mark that is easily visible formed on the tightening ring of the teat or on the neck of the feeding bottle.

Figure 4:
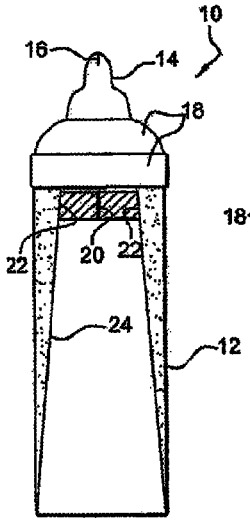
FIG. 4 is a top diagrammatical view of a feeding bottle according to an alternative of the invention.

FIG. 4 shows an alternative of the invention wherein the visual marks 20, 22 are not carried by the tightening ring 18 of the teat 14 but are formed on the body 12 of the feeding bottle 10, more preferably in the vicinity of its neck used for the mounting of the teat 14. It is as such possible to mount any teat of the symmetric type and any tightening ring on the neck of the feeding bottle 10 while still benefiting from the advantages procured by the invention.

In this case, the neck can comprise a colored annular strip, or have another aspect than the rest of the feeding bottle, which extends over approximately 90 degrees around the axis of the feeding bottle and of which the ends form the marks 22 while its median portion comprises a dash forming the mark 20.

Figure 5:
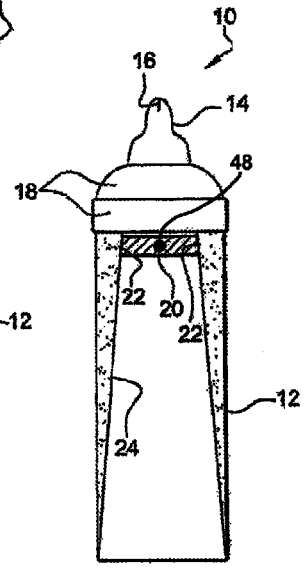
FIG. 5 is a top diagrammatical view of a feeding bottle according to another alternative of the invention.

Alternatively, and such as is shown in FIG. 5, one of the marks, for example the central mark 20 for angular positioning of the feeding bottle around its axis, can be formed by a unidirectional air intake valve 48 intended to prevent the establishment of a vacuum in the feeding bottle as feeding takes place, this vacuum creating a resistance to the flow of the liquid and being a cause of fatigue of the infant. Such a valve 48 reduces the efforts required by the suction and increases the effectiveness of the feeding, without fatiguing the infant. This valve 48 is located slightly above a visual mark indicating a maximum level of filling of the feeding bottle.

In order to respect the palate and the gums of infants, there are so-called asymmetric teats, which are not symmetrical in relation to a central axis, but nevertheless comprise a plane of symmetry intended to be directed vertically during feeding.

The use of such an asymmetric teat requires, after tightening on the feeding bottle, directing the visual marks 20, 22 around the axis of the feeding bottle in order to give them an adequate position in relation to the teat, i.e. a position wherein the angular orientation central mark 20 of the feeding bottle, which must be directed upwards, passes through the plane of symmetry of the teat which itself must be directed vertically.

Figure 6:
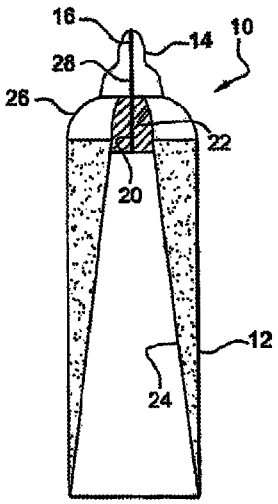
FIG. 6 is a top diagrammatical view of a feeding bottle according to yet another alternative of the invention.

For this, the alternative shown in FIG. 6 provides for the visual marks 20, 22 to be formed on a crown or an annular strip 26 which is rotatably mounted on the tightening ring of the teat. The teat used may carry a visual mark 28 indicating its plane of symmetry and intended to be directed upwards. It is then sufficient to align the visual angular orientation central mark 20 formed on the crown with the aforementioned mark of the teat, after fastening of the latter, in order to be able to use the feeding bottle by taking advantage of the indications of the positioning side mark(s) 22 of the free surface of the liquid.

Alternatively, the visual marks 20, 22 can be formed on a covering crown rotatably mounted on the neck of the feeding bottle.

In another alternative of the invention at least some of the visual marks 20, 22 are formed on the teat 14 itself.

Figure 7:
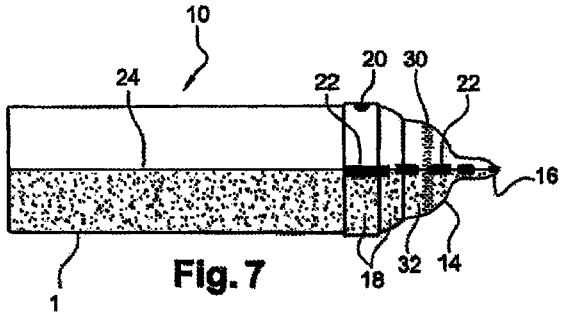
FIG. 7 is a side diagrammatical view of a feeding bottle according to yet another alternative of the invention.

FIG. 7 shows an example of an embodiment wherein the side positioning mark 22 of the free surface of the liquid is formed on a teat 14 of large size. Another side mark 22 and an angular orientation central mark 20 can also be formed on the tightening ring 18 of the teat, the latter then being positioned in such a way that the side marks 22 on the ring 18 and on the teat 14 are aligned.

The arrangement of one or of several marks 20, 22 on the teat is particularly advantageous with teats having dimensions that are sufficiently large so that during the feeding, a portion 32 at the base of the teat remains visible, the lips of the baby not being positioned beyond a level symbolized by the reference 30 in FIG. 7.

Generally, it is sufficient according to the invention that the person giving the feeding bottle, after having checked that the central mark 20 is correctly positioned upwards, adjusts the inclination of the feeding bottle in such a way that the free surface 24 of liquid in the feeding bottle passes through the or one of the side marks 22. In this way, the hydrostatic pressure is maintained close to zero at the orifice 16 of the teat 14, and the liquid will flow only if the infant is actually feeding, with no risks for the latter.

The following paragraphs comprise new material that has been added in the instant CIP application.

We define that the word "nipple" is equivalent to the word "teat"; and also that the word "nipple" means (for this application) an "artificial nipple" or "bottle nipple" (as used, for example, in FIGS. 1-3), unless otherwise stated. We define that the feature called a "second visual mark" (e.g., feature numbered 22 in FIGS. 1-3) can also be called a "side positioning mark" or, simply, a "side mark". The term "tightening ring" is equivalent to "nipple crown" and "crown ring", unless otherwise stated. The term "visual mark" is broadly defined herein to include not only marks that can be seen visually, but also marks that can be felt, in a tactile sense (e.g., a raised bump or a raised line, ridge; or a depression (sunken bump) or a groove (sunken line)). We define the phrase: "the free surface 24 of the liquid passes through a side mark 22" as meaning that it is actually a horizontal plane (called the liquid level plane) which coincides with and extends horizontally beyond the free surface 24 of the liquid that is what physically intersects and passes through the side mark 22. This is because most of the side marks 22 are illustrated herein as being located on the outside of the bottle/crown/etc., and, hence, are not being in direct contact with the liquid inside the bottle.

With the objective of minimizing the hydrostatic pressure at the outlet orifice of a nipple during feeding, a variety of different techniques, structures, and methods have been developed, according to the present invention, to accomplish that objective.

The first method is empirically based. The method comprises: (before giving the bottle to an infant) tilting the bottle at a variety of different angles (inclinations) with respect to the horizontal, and then determining (by visual observation) a specific angle, $\theta_{drip}$, at which liquid just starts to drip slowly from the nipple. Once this angle, $\theta_{drip}$, has been determined, it follows then that the optimum angle, $\theta_{opt}$, for infant feeding (i.e., the inclination at which the hydrostatic pressure at the orifice is effectively zero, and the dripping is observed to have stopped) is an angle that is just slightly less than $\theta_{drip}$. In other words, $\theta_{opt}<\theta_{drip}$. Subsequently, after some period of feeding, the volume of liquid in the bottle is reduced; and then the steps of this first method have to be repeated (after removing the bottle from the infant), in order to determine a new optimum angle. And, so on.

Figure 8A:
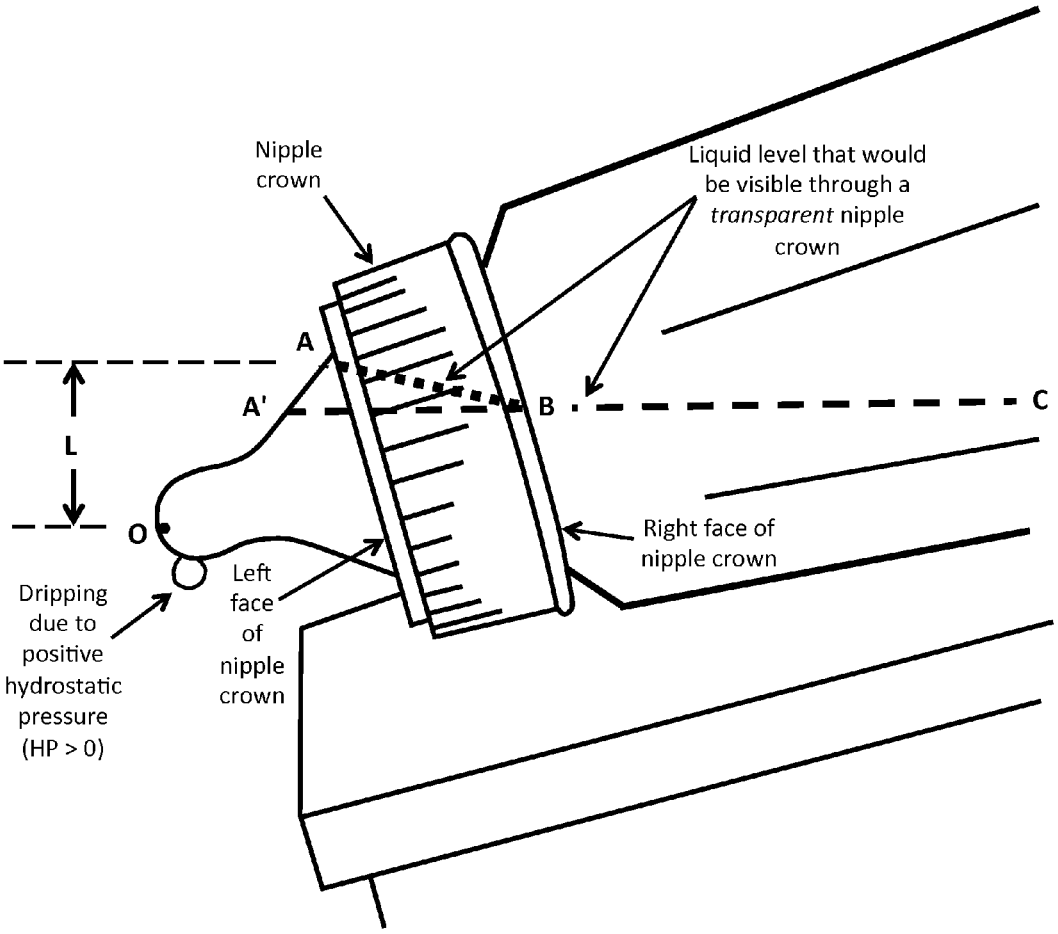
FIG. 8A shows a side view of a conventional 5 oz. feeding bottle that has been partially filled with a colored liquid.
Figure 8B:
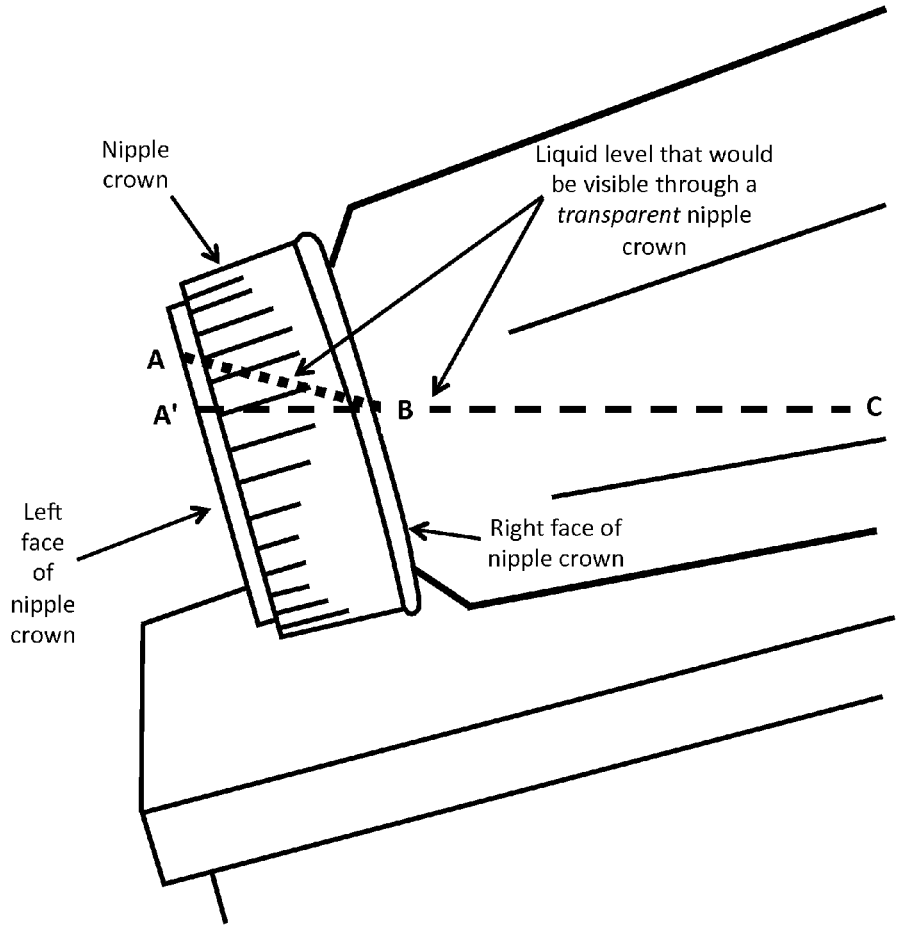
FIG. 8B shows a side view of a conventional 5 oz. feeding bottle that has been partially filled with a colored liquid, and the nipple has been "blacked out" to simulate being occluded by an infant's lips.
Figure 9:
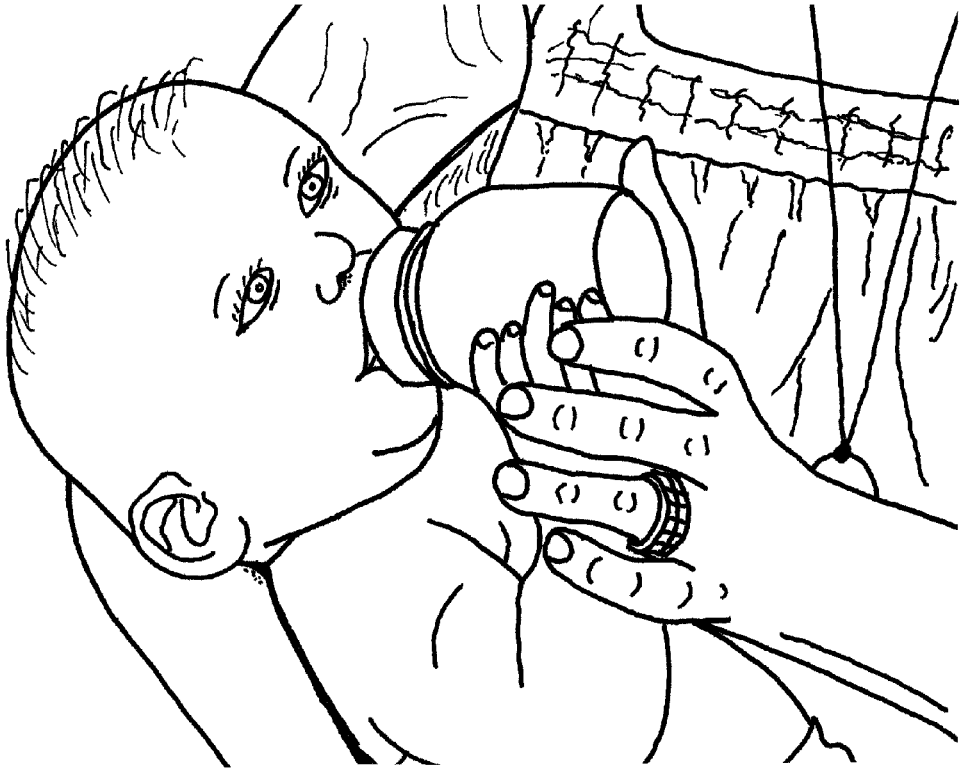
FIG. 9 shows a photograph of a baby feeding from a conventional 5 oz. bottle with a standard nipple (not visible).

The second method can be best introduced by referring to FIGS. 8-10. FIG. 8A shows a side view of a conventional 5 oz. feeding bottle that has been partially filled with a liquid (colored water, in this case). In this demonstration, the bottle has been inclined (on a ramp) at an angle that is steep enough to cause dripping from the nipple's orifice, due to a positive hydrostatic pressure (HP>0). The positive hydrostatic pressure is caused by the weight of liquid at its highest point "A" above the outlet orifice "O"; with the amount of pressure being proportional to the vertical distance, L.

FIG. 9 shows a photograph of a baby feeding from a conventional 5 oz. bottle with a standard nipple (not visible). As is often the case with full-term babies, their lips mostly surround the nipple (from nipple tip to nipple base), and their lips can contact the face of the nipple crown (i.e., tightening ring). When the nipple is completely occluded by the infant's lips, this prevents viewing of the liquid level inside of the nipple during feeding; thus making much more difficult to determine if the free surface of the liquid actually passes through the outlet orifice of the nipple (which would achieve substantially zero hydrostatic pressure).

Since the geometry of the neck (collar) of the bottle is typically very different than the body of the bottle, one cannot presume a priori that the liquid level in the neck region underneath the nipple crown is just the continuation of what is seen in the transparent bottle. This problem is illustrated in FIG. 8A. Here, the free surface of the red liquid inside the transparent body of the bottle is represented by a dashed (long-short) horizontal line segment CB (in white). A simple extension of line segment CB to point A' on the left face of the nipple crown (via dashed line BA') does not provide the correct estimation of the level of the liquid's free surface with respect to the nipple orifice. A more correct estimation of the liquid level underneath the nipple crown is illustrated by the dashed line AB (in black), because point A correctly matches the actual (true) level of liquid, which can be readily seen inside of the transparent nipple in FIG. 8A.

In FIG. 8B, the nipple has been "blacked out" to simulate being occluded by an infant's lips (as in FIG. 9). This highlights the difficulty of estimating or predicting exactly where the actual liquid level line would intersect the far face (i.e., left face) of an opaque nipple crown (e.g., at point A or point A'). However, if the nipple crown was transparent, or substantially transparent, then a user could visualize the actual (true) liquid level (free surface) in the neck region of the bottle underneath the nipple crown.

Accordingly, in a preferred embodiment of the present invention, the nipple crown (i.e., tightening ring) is transparent, or substantially transparent. With a transparent nipple crown, the user can see the level of liquid actually reaching the baby's lips.

The term "substantially transparent" is defined herein as meaning: "an object that is sufficiently clear so that a person can see through the object and correctly identify the level of a liquid surface inside or behind the object". The term "substantially transparent" includes being completely transparent (clear).

Empirically, we have discovered that the hydrostatic pressure can be made substantially zero by tilting the bottle to adjust the liquid level in at least one of the following ways, i.e., so that: (1) the liquid level lines up with the lower edge of the upper lip of the baby, or (2) the liquid level lines up with the corner of the baby's lip. The task of performing such alignments is made much easier when the nipple crown is transparent, or substantially transparent; and this is particularly so when the baby's lips completely occlude visual observation of the nipple (as illustrated in FIG. 9).

In other preferred embodiments of the present invention, all components of a feeding bottle system are transparent, or substantially transparent.

With reference to components that were presented earlier in this application, specific components of a feeding bottle system that can be transparent, or substantially transparent, comprise those components that are generally located in the vicinity of the bottle's neck, including, but not limited to: tightening ring, nipple crown, covering crown, annular strip, rotatably mounted crown, bottle crown, crown, and unidirectional air intake valve.

In some embodiments of the present invention, nipple crown 18 can have a specific, calibrated arrangement of marks, such that the combination of at least two different types of marks can be used to guide a caregiver to accurately and rapidly position a feeding bottle in two different directions (angular orientation, and inclination/pitch) in such a way that the hydrostatic pressure is substantially close to zero at the outlet orifice during feeding. The positioning/guide marks (20 and 22) can be lines (solid or dashed, straight or curved), dashes, circles, points, etc. that are printed on the surface of a crown 18; and they can be any color, including black. Printed marks can be laser printed, screen printed, or applied as a decal. Alternatively, the marks can comprise raised dots, bumps, raised lines or ridges that are formed when the nipple crown is formed itself (e.g., by injection molding). Alternatively, the marks can comprise recessed or sunken/depressed features, such as recessed bumps, dots, lines, grooves, etc. These recessed features could also be formed when the nipple crown itself is formed. The recessed features can be filled with a colored ink. Alternatively, a combination of raised and recessed features can be used for the marks.

Conventional nipple crowns typically have a series of periodic, ornamental features (raised lines, sunken grooves, etc.) that serve to increase the grip when the crown is rotated, as well as being decorative. These conventional ornamental marks would, in general, be replaced by the particular set of positioning/guide marks 20 and 22, whose locations on the crown are calibrated for a specific bottle design and geometry. The calibrated marks 20 and 22 can also serve as ornamental/decorative features, and for increasing the grip when being rotated.

Optionally (as will be shown in FIGS. 10A and 10B), additional information can be printed or formed on the nipple crown, such as alpha-numeric lettering, that can provide specific, useful information for the caregiver.

In some embodiments, the nipple crown 18 can comprise just a central positioning mark 20. Alternatively, the nipple crown 18 can comprise just side positioning marks (22, 22', etc.). In preferred embodiments, the nipple crown 18 comprises both the central positioning mark 20, and one or more side positioning marks (22, 22', etc.).

Figure 10A:
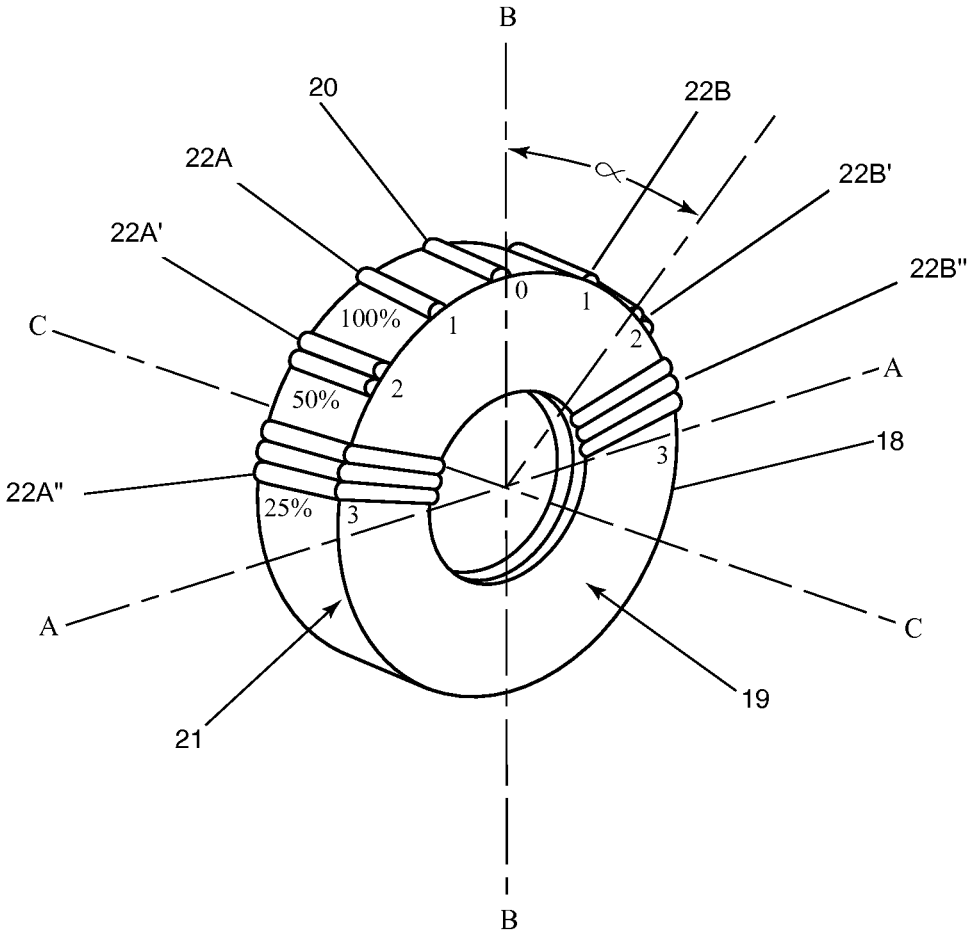
FIG. 10A shows an isometric view of an embodiment of a calibrated nipple crown, according to the present invention.
Figure 10B:
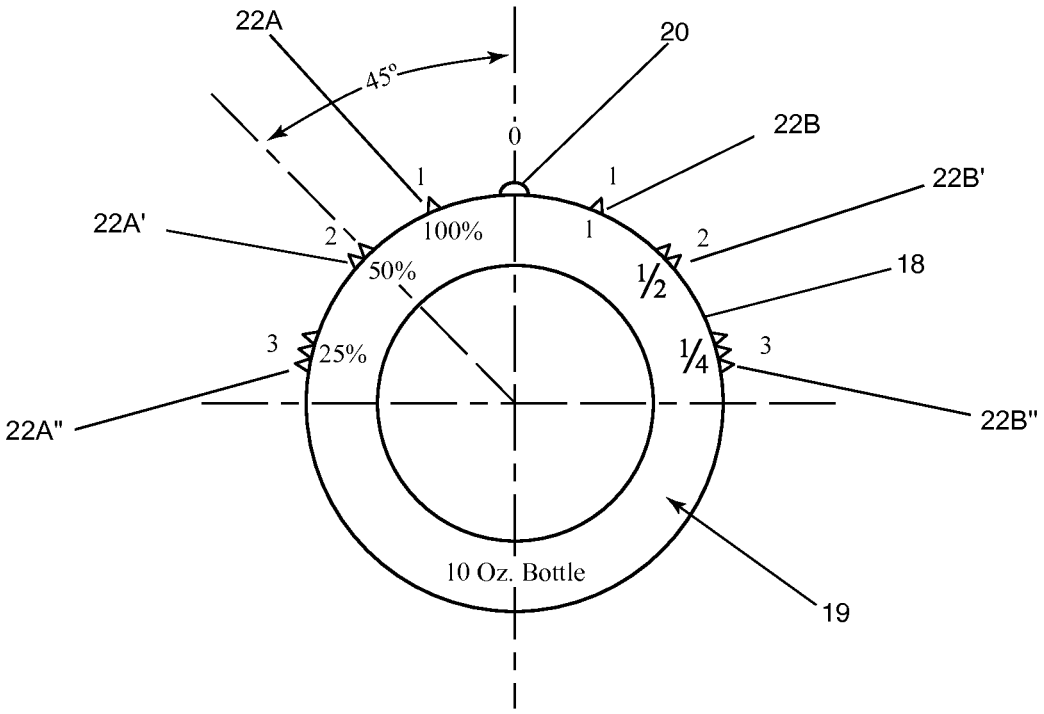
FIG. 10B shows a front view of an embodiment of a calibrated nipple crown, according to the present invention.

FIGS. 10A and 10B illustrate an embodiment of a calibrated nipple crown, according to the present invention. Calibrated nipple crown 18 has a central positioning mark 20 (illustrated as a large, raised bump) positioned at the top of crown 18. Crown 18 also comprises three pairs of side positioning marks: 22A, 22A', and 22A" (which are mirrored symmetrically on the opposite side as paired side marks 22B, 22B', and 22B"). All of the marks are printed or formed on the side face 21 of crown 18. The first side mark 22A, and its pair 22B, comprises a single line; the second side mark 22A', and its pair 22B', comprises two, closely-spaced parallel lines; and the third side mark 22A", and its pair 22B", comprises three, closely-spaced parallel lines (as well as their symmetric, mirror-image marks reflected on the opposite side of the vertical reference line). The location of a particular side mark is specified by its angular position, $\alpha$, with respect to a vertical reference line passing through the central positioning mark 20. For example, the pair of second side marks 22'-left and 22'-right are located at α=+/−45° from the vertical. Note that in FIG. 10B, the central mark 20 is illustrated schematically as a large, raised line or bump(s); and the side marks are illustrated schematically as raised lines or triangular-shaped ridges. Note that in FIG. 10A, as an example, the lines 22A" and 22B" that comprise the third set of side marks wrap-around continuously from the side face 21 to the front face 19 of crown 18. This option can be used with any, or all, of the side marks.

In FIGS. 10A and 10B, additional information can be printed or formed on the nipple crown, such as alpha-numeric lettering, that can provide specific, useful information to the caregiver. The information can be located on the front face 19, or on the side face 21, or on both faces 19 and 21 of crown 18. In these figures, the amount of liquid volume (in volume %), is printed on the side face 21, next to each set of side marks 22A, 22A', and 22A" (and their paired marks 22B, 22B', and 22B"). For example, the first side mark 22A/B corresponds to a full bottle (100%). The second side mark 22A'/B' (two lines) corresponds to a 50% full bottle. And, the third side mark 22A"/B" (three lines) corresponds to a 25% full bottle. Note that in FIG. 10B, on the right hand side, the volume is indicated alternatively as a numerical fraction (e.g., the third side mark 22A"/B" is labeled as "¼", and the second side mark 22A'/B' is labeled as "½"). Also, in FIG. 10B, the size of the bottle is printed on the front face 19 (e.g., "10 oz. bottle").

Figure 11:
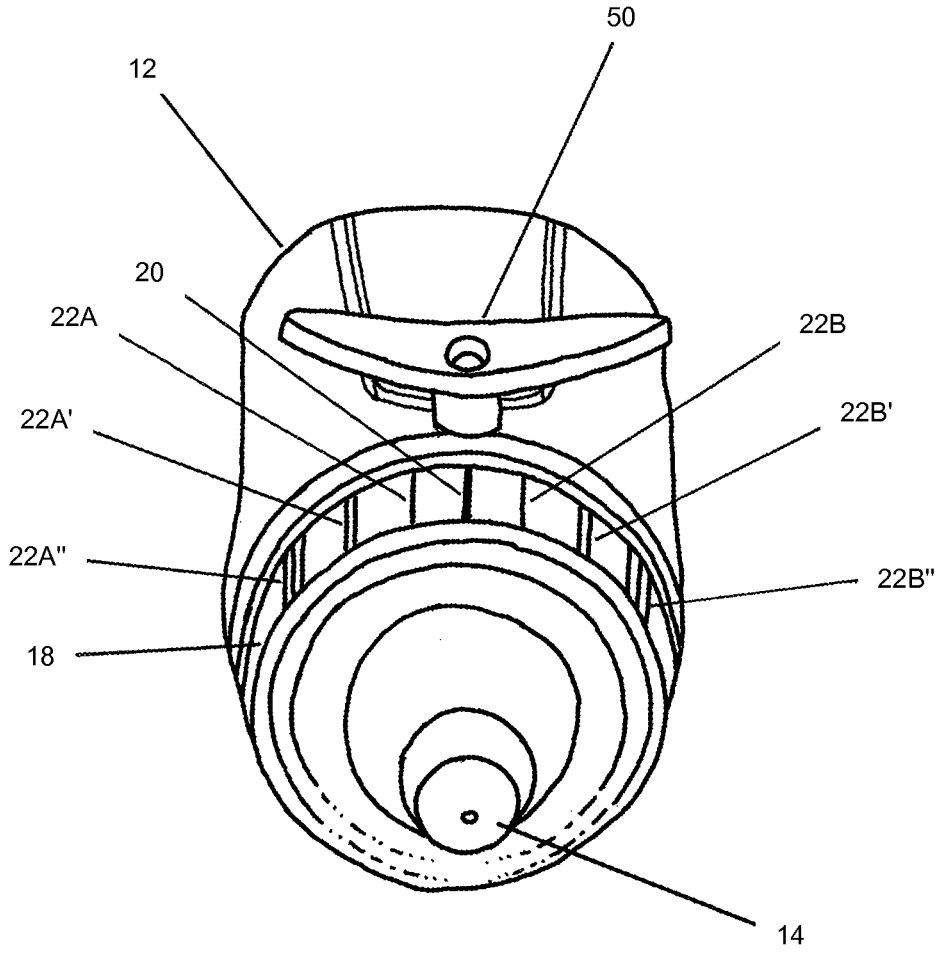
FIG. 11 shows a front view of an example of a nipple crown having a combination of a central positioning mark at the top of the crown, and symmetrical pairs of side position marks located at three different angular positions, according to the present invention.
Figure 12:
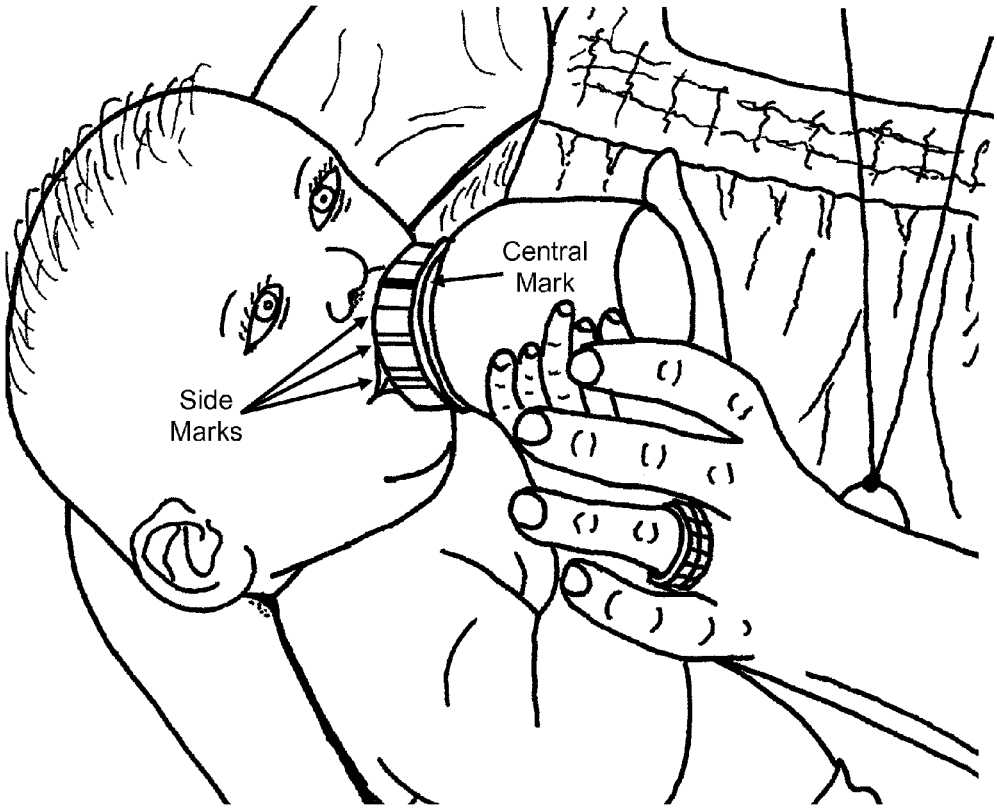
FIG. 12 shows a side view of another example of a nipple crown having a combination of a central positioning mark at the top of the crown, and symmetrical pairs of side position marks located at three different angular positions, according to the present invention.

FIGS. 11 and 12 illustrate other examples of nipple crowns 18 having a combination of a central positioning mark 20 at the top of the crown, and symmetrical pairs of side position marks 22A/B, 22A'/B', and 22A"/B" located at three different angular positions; similar to the side marks shown in FIGS. 10A and 10B. FIG. 11 also shows an example of a unidirectional air intake valve 50 mounted in body 12 at an angular position that aligns with the vertical alignment position of the central mark 20. Note: unidirectional valve 50 is not shown in FIG. 12.

In general, any number of side marks 22 can be printed or formed on a nipple crown 18 at different angular positions around the circumference of the crown (note: a double or triple-line "mark" is considered a single "mark", in this paragraph), including, but not limited to: 1 mark, 2 marks, 3 marks, 4 marks, 5 marks, and 6 marks. However, adding more side marks circumferentially beyond the three sets that are illustrated in FIGS. 10A, 10B, 11, and 12, may not provide too much more of a benefit, because the volume of liquid remaining in the bottle for those extra marks would be less than about 25%.

The specific angular position (angle, α) of a specific side positioning mark 22, which is used for guiding the caregiver how much angle to tilt (incline) the bottle, is calibrated (selected) for a specific feeding bottle system 44, and for a specific amount (volume) of liquid contained inside the bottle. For example, the second side mark 22A'/B' is placed at α=+/−45° in FIGS. 10A and 10B, which has been calibrated to provide for zero hydrostatic pressure at the nipple orifice, when the bottle is 50% full of liquid (and this is marked on the face). And, for the third side mark 22A"/B" (triple lines), its angular position, α, is in the range of 80°-90° from vertical, and this corresponds to a bottle that is approximately ¼ full (25% full). In general, then, there is a one-to-one (1:1) correspondence between the amount (e.g., in percentage) of liquid remaining in the bottle and the specific angular location of a side mark 22 on a nipple crown 18. This will be explained further, in reference to FIG. 13A.

Figure 13A:
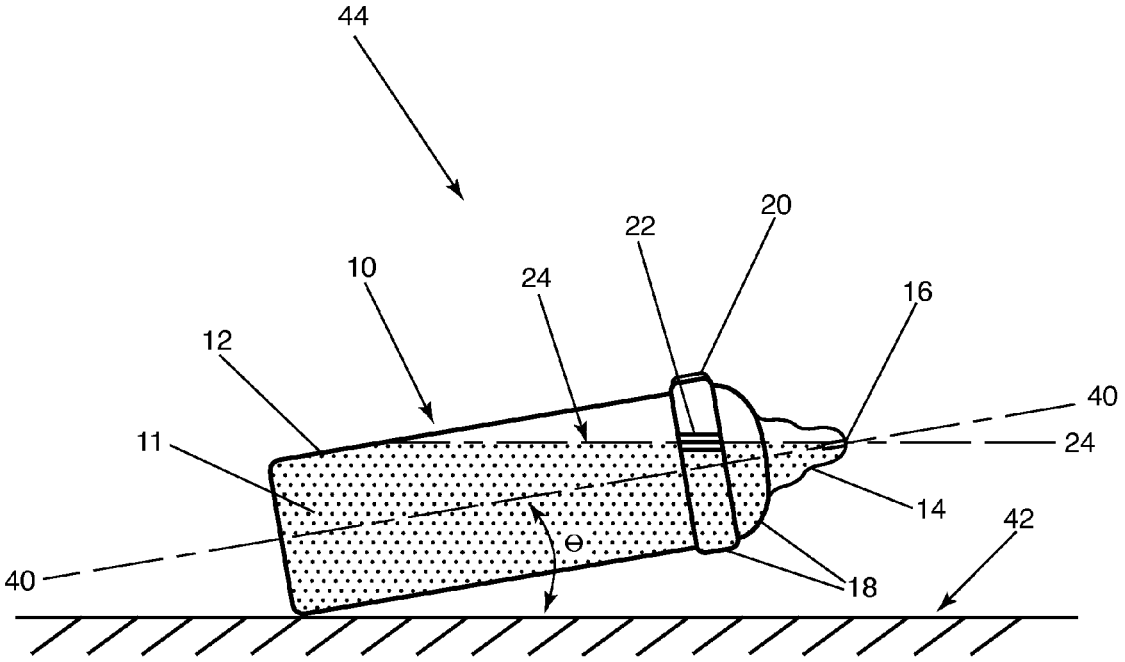
FIG. 13A shows a side view of an example of a feeding bottle system, according to the present invention.

FIG. 13A illustrates a first embodiment of a feeding bottle system 44, according to the present invention. System 44 comprises a bottle 10 with a body 12 and a neck (not shown), nipple crown 18 attached to the neck, and nipple 14 mounted/clamped to the neck of bottle 10 with a nipple crown 18. Bottle 10 has a central axis 40 along the bottle's long direction. Nipple crown 18 has a central positioning mark 20 located at the top of the crown; and at least one side positioning mark 22 located on the side of the crown 18. A specific volume (amount) of liquid 11 is contained inside the bottle 10. Liquid 11 has a free surface 24, which appears as a horizontal line 24 when viewed from the side (as in FIGS. 13A-D). The central axis 40 of bottle 10 has been inclined at a specific tilt (pitch angle), θ, which has been selected in this figure so that the (horizontal) liquid level plane (not numbered) that coincides with the free surface 24 passes simultaneously through: (1) side mark 22, and (2) the outlet orifice 16 of nipple 14. At this specific inclination, θ; and for this specific volume of liquid 11, the hydrostatic pressure at the outlet orifice 16 is essentially zero because there is no liquid residing above the level of the outlet orifice 16.

Figure 13B:
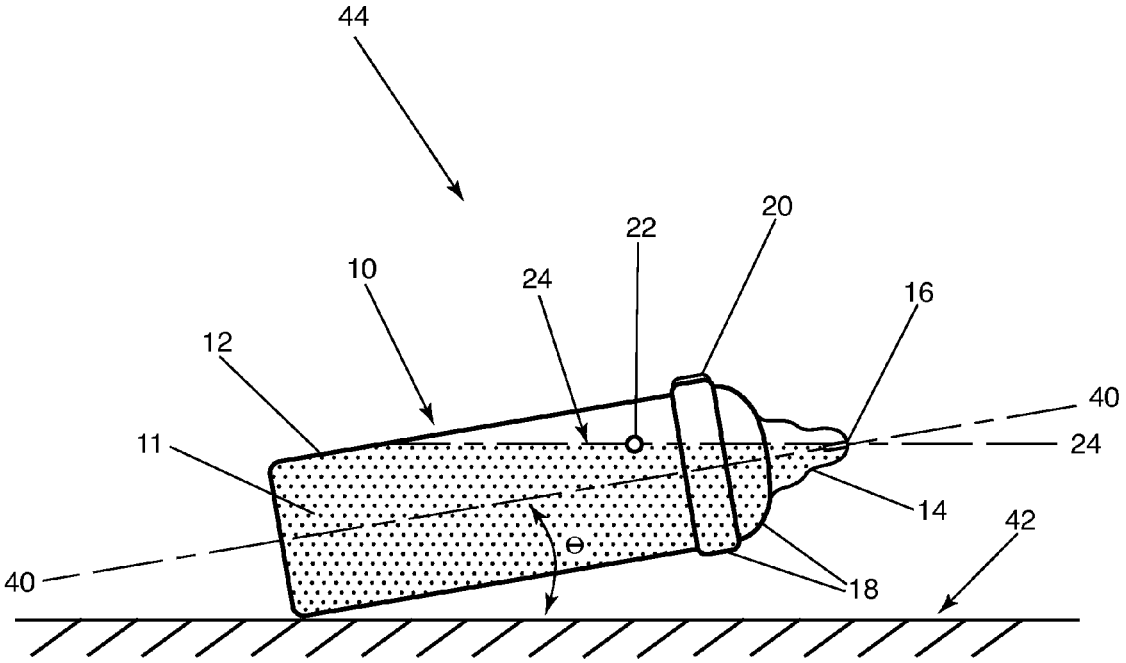
FIG. 13B shows a side view of another example of a feeding bottle system, according to the present invention.

FIG. 13B illustrates another embodiment of a feeding bottle system 44, according to the present invention. In this embodiment, side positioning mark 22 is a filled circle (dot) that is located on the body 12 of bottle 10, at a point near the neck. Nipple crown 18 does not have any side marks in this example.

Figure 13C:
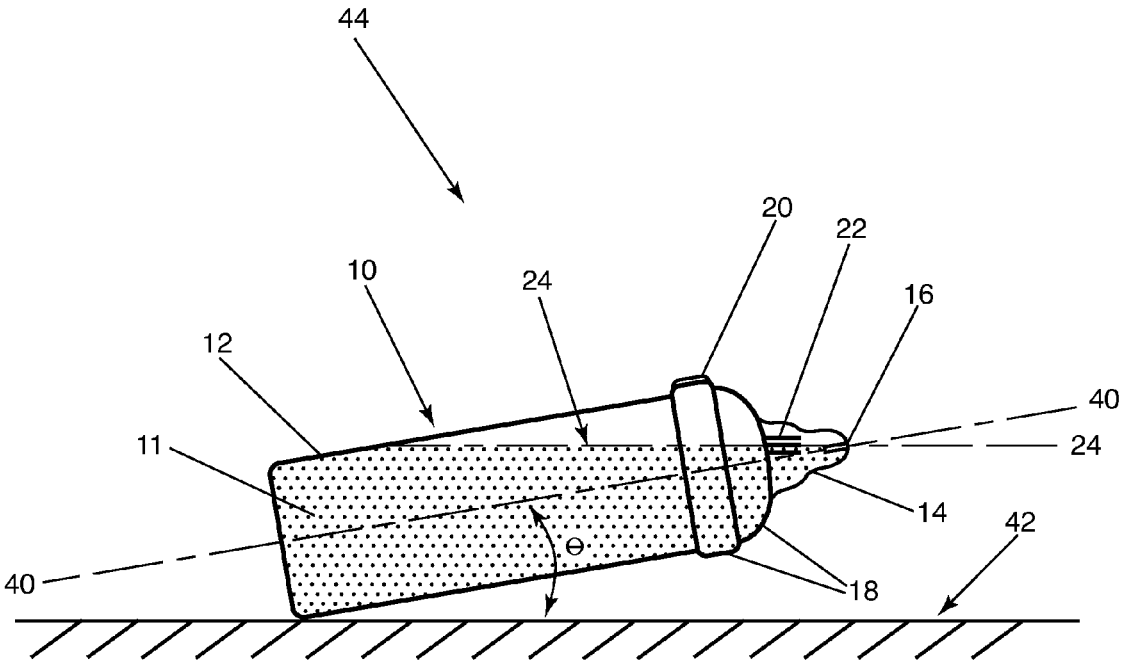
FIG. 13C shows a side view of another example of a feeding bottle system, according to the present invention.

FIG. 13C illustrates another embodiment of a feeding bottle system 44, according to the present invention. In this embodiment, side positioning mark 22 is a short line (dash) that is located on the nipple 14, at a point near the base of the nipple (i.e., towards the neck). Nipple crown 18 does not have any side marks in this example.

Figure 13D:
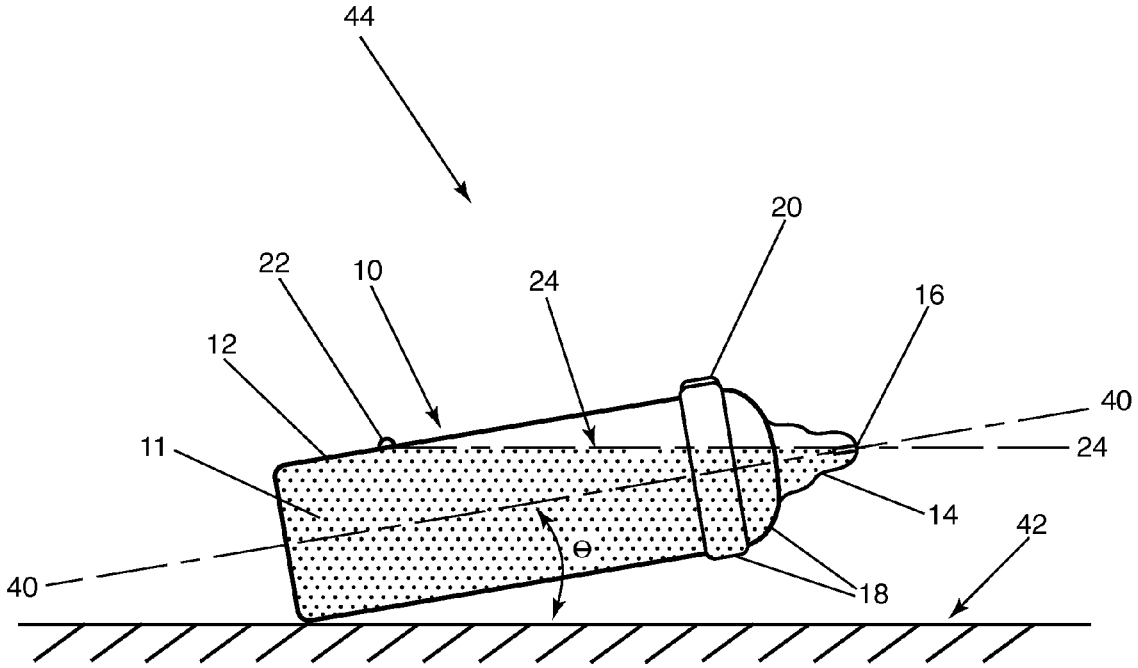
FIG. 13D shows a side view of another example of a feeding bottle system, according to the present invention.

FIG. 13D illustrates another embodiment of a feeding bottle system 44, according to the present invention. In this embodiment, side positioning mark 22 is a raised bump or ridge formed on the body 12 of bottle 10; and side mark 22 is located near the bottom of the bottle 10. Nipple crown 18 does not have any side marks in this example. Note that in this case, the separation distance between the side mark 22 and the outlet orifice 16 is relatively large (as compared, for example in FIG. 13C, to the much shorter separation distance between side mark 22 (which is placed on the nipple) and the outlet orifice 16.

In general, then, the larger the separation distance is between the side mark 22 and the outlet orifice 16, the easier and faster it is for the caregiver to adjust the tilt of the bottle and determine the correct amount of inclination to give to the bottle, in order to create the desired condition of substantially zero hydrostatic pressure at the outlet orifice 16.

Figure 14:
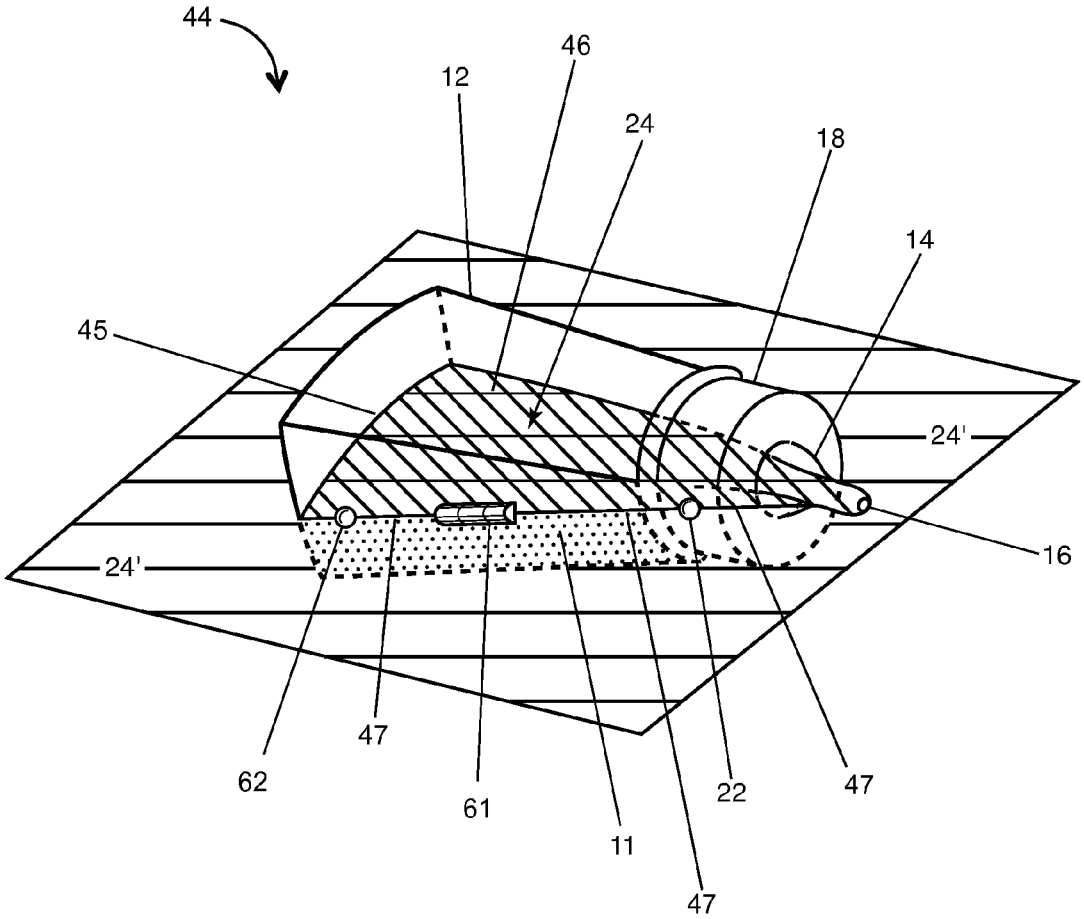
FIG. 14 shows an isometric view of another example of a feeding bottle system, according to the present invention.

In general, for any embodiment of a feeding bottle system 44, according to the present invention, one or more of the side positioning marks 22 can be placed or located at any position where the horizontal liquid level plane 24', which coincides with a free surface 24 (of a liquid inside the bottle) that passes through an outlet orifice 16 of a nipple 14, intersects any of the components that comprise a feeding bottle system 44; including, but not limited to: a bottle's body 12, a bottle's neck, a nipple crown 18, or a nipple 14. This is illustrated in the example shown in FIG. 14, which shows an isometric view of another example of a feeding bottle system 44, according to the present invention. Here, the horizontal liquid level plane 24', which coincides with the free liquid surface plane 24, at the crisscrossed hatched region 46, intersects the physical boundaries (surface planes) of body 12 at a number of locations. The intersection of plane 24' with a surface plane of body 12 produces a common intersection line. For example, line 45 is the intersection of plane 24' with the far end surface of body 12. Likewise, line 47 represents the intersection of plane 24' with a side wall of body 12. As can be seen in FIG. 14, the common intersection line 47 passes through both side mark 22, and outlet orifice 16 of nipple 14 (which satisfies the condition of zero hydrostatic pressure at outlet orifice 16). Additional side positioning marks 61 and 62 can be placed at various locations along the walls of body 12 along intersection line 47.

In a preferred embodiment of a feeding bottle system, the system comprises:

a feeding bottle comprising a body, a central axis, and a neck configured for mounting a nipple thereto; and at least two positioning marks, comprising:

a central mark, for orienting an angular position of the bottle around its central axis so that the central mark faces upwards during feeding; and a side mark, configured in such a way as to guide a user when inclining the bottle relative to the horizontal until an optimum angle of inclination is reached where a free surface of a liquid inside the bottle simultaneously passes through both the side mark and an outlet orifice of an nipple mounted on the neck, thereby causing a hydrostatic pressure of the liquid, at the outlet orifice, to be substantially zero.

A first example of a method of using a feeding bottle system, according to the present invention, comprises: (a) adjusting the angular orientation of the bottle about it's central axis so that a central positioning mark is correctly positioned upwards; and then (b) adjusting the inclination of the feeding bottle with respect to the horizontal in such a way that the free surface of a specific volume of liquid contained in the bottle passes simultaneously through (1) the outlet orifice of a nipple mounted to the bottle, and (2) at least one side positioning mark. As a result, the hydrostatic pressure of the liquid at the outlet orifice of the nipple is either zero, or substantially close to zero. Then, the liquid will only flow when the infant is actually feeding and providing a suction force of sufficient magnitude to overcome any internal resistance to flow across the outlet orifice (e.g., due to flow resistance across a slit-type orifice).

A second example of a method of using a feeding bottle system, according to the present invention, comprises: using a feeding bottle system, wherein the system comprises:

a feeding bottle with a neck, a central axis, and a liquid contained within the bottle;

a nipple, with an outlet orifice, mounted on the neck;

a central positioning mark; and at least one side positioning mark;

wherein the liquid has a free surface; and wherein the method comprises:

a) adjusting an angular orientation of the feeding bottle around its central axis until the central positioning mark is facing upwards; and then b) adjusting the inclination of the bottle with respect to the horizontal in such a way so that the free surface of the liquid passes simultaneously through both the side positioning mark and the outlet orifice of the nipple; thereby causing the hydrostatic pressure of the liquid at the outlet orifice to be substantially zero.

What is claimed is:

1. A feeding bottle system comprising:

a feeding bottle comprising an elongated body with a central longitudinal axis, and a neck configured for mounting a nipple thereto; and at least two positioning marks, comprising:

a central mark (20) configured for orienting an angular position of the bottle around its central axis so that the central mark (20) faces upwards during feeding; and a first side mark (22A) configured in such a way as to guide a user to incline the bottle relative to the horizontal until an optimum inclination is reached where a free surface of a liquid inside the bottle simultaneously passes through both the first side mark (22A) and an outlet orifice of a nipple mounted on the neck, thereby causing a hydrostatic pressure of the liquid at the outlet orifice to be substantially zero; and further comprising a nipple crown for mounting a nipple to the neck of the feeding bottle;

wherein the positioning marks are formed or printed on the nipple crown; and wherein the central mark (20) is disposed on the nipple crown (defining a vertical reference line passing through the central mark); and wherein the nipple crown further comprises three pairs of side positioning marks: a first pair of side marks (22A, 22B), a second pair of side marks (22A', 22B'), and a third pair of side marks (22A", 22B"), disposed on at least a side face of the nipple crown; and wherein the three side marks (22A, 22A', 22A") are also mirrored symmetrically as three paired side marks (22B, 22B', 22B") paired respectively across the vertical reference plane on an opposite side of the nipple crown; and further wherein: the first pair of side marks (22A, 22B) comprises a single line or bump/ridge; the second pair of side marks (22A', 22B') comprises two closely-spaced parallel lines or bumps/ridges; and the third pair of side marks (22A", 22B") comprises three closely-spaced parallel lines or bumps/ridges.

2. The feeding bottle system of claim 1, further comprising the label "100%" printed on the nipple crown next to the first pair of side marks (22A, 22B); the label "50%" printed on the nipple crown next to the second pair of side marks (22A', 22B'); and the label "25%" printed on the nipple crown next to the third pair of side marks (22A", 22B").

3. The feeding bottle system of claim 1, wherein the second side mark (22A') is located at an angular separation between the central mark (20) and the second side mark (22A') of approximately 45 degrees.

4. The feeding bottle system of claim 1, wherein each positioning mark comprises one or more lines or bumps/ridges that are printed or formed on both the side and front faces of the nipple crown; and wherein each line or bump/ridge wraps-around the side and front faces of the nipple crown in a continuous, unbroken manner.

5. The feeding bottle system of claim 1, wherein the nipple crown is transparent or substantially transparent.

6. The feeding bottle system of claim 1, further comprising a unidirectional air intake valve recessed in the body of the bottle; and wherein the valve forms the central mark (20) for guiding the angular positioning of the feeding bottle around its central axis.

7. A calibrated nipple crown, comprising a standard nipple crown that has been modified to comprise:

a central mark (20) disposed on the nipple crown, defining a vertical reference plane passing through the central mark (20); and three pairs of side positioning marks: a first pair of side marks (22A, 22B), a second pair of side marks (22A', 22B'), and a third pair of side marks (22A", 22B") disposed on at least a side face of the nipple crown; wherein the three side marks (22A, 22A', 22A") are also mirrored symmetrically as three paired side marks (22B, 22B', 22B") paired respectively across the vertical reference plane onto an opposite side of the nipple crown; and further wherein: the first pair of side marks (22A, 22B) comprises a single line or bump/ridge; the second pair of side marks (22A', 22B') comprises two closely-spaced parallel lines or bumps/ridges; and the third pair of side marks (22A", 22B") comprises three closely-spaced parallel lines or bumps/ridges; and wherein the nipple crown further comprises:

the label "100%" printed on the nipple crown next to the first pair of side marks (22A, 22B);

the label "50%" printed on the nipple crown next to the second pair of side marks (22A', 22B'); and the label "25%" printed on the nipple crown next to the third pair of side marks (22A", 22B").

8. The feeding bottle system of claim 7, wherein each one of the second pair of side marks (22A', 22B') is located at an angular separation between the central mark (20) and said second side mark of approximately 45 degrees.

9. The feeding bottle system of claim 7, wherein each positioning mark comprises one or more line or bump/ridge that is printed or formed on both the side and front faces of the nipple crown; and wherein each line or bump/ridge wraps-around the side and front faces of the nipple crown in a continuous, unbroken manner.

* * * * *